US005834399A

United States Patent [19]

Bauer et al.

[11] Patent Number: 5,834,399

[45] Date of Patent: Nov. 10, 1998

[54] SUBBING LAYER FOR DYE-DONOR ELEMENT USED IN THERMAL DYE TRANSFER

[75] Inventors: Charles L. Bauer; Gary S. Freedman, both of Webster; Karen M. Kosydar, Penfield, all of N.Y.

[73] Assignee: Eastman Kodak Company, Rochester, N.Y.

[21] Appl. No.: 995,688

[22] Filed: Dec. 22, 1997

[51] Int. Cl.[6] ..... B41M 5/035; B41M 5/38

[52] U.S. Cl. ..... 503/227; 428/195; 428/480; 428/500; 428/913; 428/914

[58] Field of Search ..... 8/471; 428/195, 428/480, 500, 913, 914; 503/227

[56] References Cited

U.S. PATENT DOCUMENTS 4,716,144 12/1987 Vanier et al. ..... 503/227
5,122,502 6/1992 Bowman et al. ..... 503/227

*Primary Examiner*—Bruce H. Hess
*Attorney, Agent, or Firm*—Harold E. Cole

[57] ABSTRACT

A dye-donor element for thermal dye transfer comprising a support having on one side thereof, in order, a subbing layer and a dye layer, and wherein the subbing layer comprises a glycidyl-containing polymer or copolymer having the following recurring monomer units:

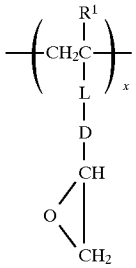

wherein:

$R^1$ is H or methyl;

L is a linking group, such as —COO— or —CONH—;

D is an alkylene group of 1 to 6 carbon atoms; and x represents from about 10 to about 100 weight percent.

18 Claims, No Drawings

SUBBING LAYER FOR DYE-DONOR ELEMENT USED IN THERMAL DYE TRANSFER

FIELD OF THE INVENTION

This invention relates to dye-donor elements used in thermal dye transfer, and more particularly to the use of a certain subbing layer for the dye layer.

BACKGROUND OF THE INVENTION

In recent years, thermal transfer systems have been developed to obtain prints from images which have been generated electronically in digital form, such as from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

After each transfer in thermal dye transfer printing, the dye-donor element must be separated cleanly from the dye-receiving element to avoid objectionable image artifacts. One artifact which arises is dye layer delamination and adhesion of part of the dye layer to the dye-receiving element. This is due mainly to a lack of adhesion of the dye layer to its polymeric support.

DESCRIPTION OF RELATED ART

U.S. Pat. Nos. 4,716,144 and 5,122,502 relate to polymers and polymeric mixtures, some of which may be crosslinked, used as subbing layers for dye-donor elements. There is a problem with these subbing layers, however, in that organic solvents are used to coat these layers. In recent years, there has been an interest in minimizing the use of solvents and preparing coatings from water. Due to their high reactivity, it is difficult or impossible to prepare some of these crosslinked subbing layers from aqueous coatable formulations.

It is an object of this invention to provide a subbing layer for a dye layer which has good adhesion which would greatly reduce the tendency for dye layer delamination. It is yet another object of this invention to provide a subbing layer for a dye layer which does not require organic solvents during manufacture, thus avoiding environmental problems.

SUMMARY OF THE INVENTION

These and other objects are achieved in accordance with this invention which relates to a dye-donor element for thermal dye transfer comprising a polymeric support having thereon, in order, a subbing layer and a dye layer comprising a dye dispersed in a binder, and wherein the subbing layer comprises a glycidyl-containing polymer or copolymer having the following recurring monomer units:

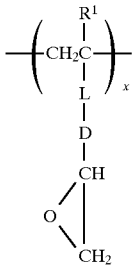

wherein:

$R^1$ is H or methyl;

L is a linking group, such as —COO— or —CONH—;

D is an alkylene group of 1 to 6 carbon atoms; and x represents from about 10 to about 100 weight percent.

DESCRIPTION OF THE REFERRED EMBODIMENTS

In a preferred embodiment of the invention, the subbing layer comprises a homopolymer containing only the glycidyl-containing monomer unit wherein $R^1$ is methyl, L is carboxyl, and D is methylene (—$CH_2$—).

In another preferred embodiment, the subbing layer comprises a copolymer of at least about 10 weight percent glycidyl-containing monomer and another acrylate or vinyl monomer, such as butyl methacrylate.

In another preferred embodiment, the subbing layer comprises a mixture of a polymer containing at least about 10 weight percent glycidyl-containing monomer and the balance a polyfunctional amine, alcohol, or acid.

Examples of glycidyl-containing materials useful for this invention are given in Table 1.

TABLE 1

| | Glycidyl-Containing Polymer |
|---|---|
| G-1 | Poly(glycidyl methacrylate) |
| | 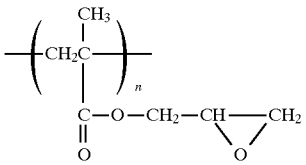 |
| | n = 300 |
| G-2 | Poly(butyl acrylate-co-allyl methacrylate) 98:2 wt % core/poly(glycidyl methacrylate) 30 wt % shell |
| G-3 | Poly(butyl methacrylate-co-glycidyl methacrylate) 90:10 wt % |

Examples of polyfunctional materials which can react with glycidyl (epoxide) groups are given in Table 2.

TABLE 2

| | Polyfunctional Additive |
|---|---|
| A-1 | Diethylene triamine (Aldrich Chemical Co.) |
| A-2 | Poly(vinyl alcohol) 88% hydrolyzed (Aldrich Chemical Co.) |
| A-3 | Poly(acrylic acid) (Aldrich Chemical Co.) |

TABLE 2-continued

| Polyfunctional Additive | |
|---|---|
| A-4 | Polyethyleneimine (Polymin P ®, BASF) |
| A-5 | Polyethyleneimine 80% ethoxylated (Scientific Polymer Products) |

The subbing layer of the invention may be present in any concentration which is effective for the intended purpose. In general, good results have been attained using a laydown of from about 0.01 g/m$^2$ to about 0.3 g/m$^2$, preferably 0.02 g/m$^2$ to 0.15 g/m$^2$.

Any image dye can be used in the dye-donor employed in the invention, provided it is transferable to the dye-receiving layer by the action of the thermal print head or laser. Especially good results have been obtained with sublimable dyes such as

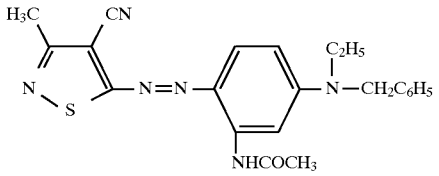

Magenta Dye M-1

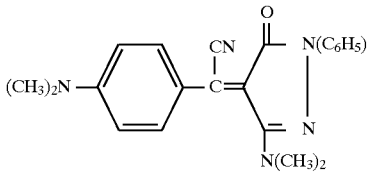

Magenta Dye M-2

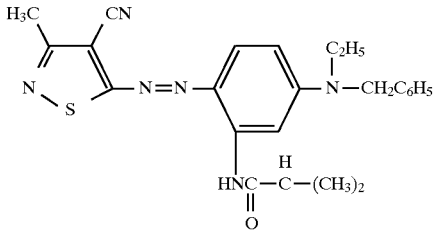

Magenta Dye M-3

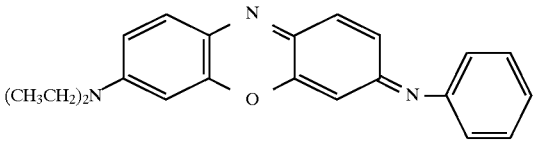

Magenta Dye M-4

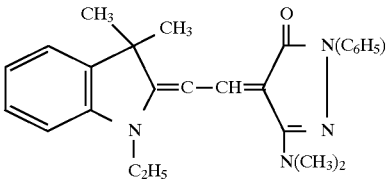

Yellow Dye Y-1

-continued

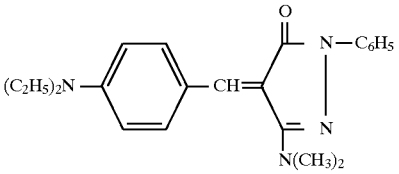

Yellow Dye Y-2

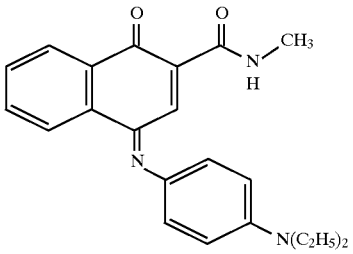

Cyan Dye C-1

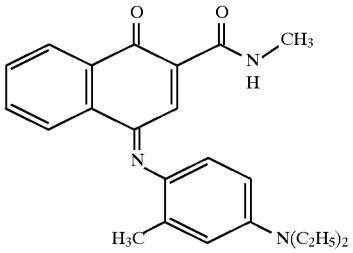

Cyan Dye C-2

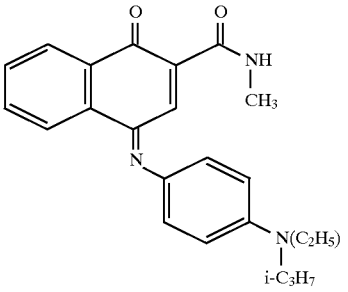

Cyan Dye C-3 or any of the dyes disclosed in U.S. Pat. Nos. 4,541,830; 4,698,651; 4,695,287; 4,701,439; 4,757,046; 4,743,582; 4,769,360; and 4,753,922, the disclosures of which are hereby incorporated by reference. The above dyes may be employed singly or in combination. The dyes may be used at a coverage of from about 0.05 to about 5 g/m$^2$ and are preferably hydrophobic.

Any material can be used as the support for the dye-donor element of the invention provided it is dimensionally stable and can withstand the heat of the laser or thermal head. Such materials include polyesters such as poly(ethylene terephthalate); poly(ethylene naphthalate); polyamides; polycarbonates; cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyetherimides. The support generally has a thickness of from about 5 to about 200 $\mu$m and may also be coated with a subbing layer, if desired, such as those materials described in U.S. Pat. Nos. 4,695,288 or 4,737,486.

The reverse side of the dye-donor element is usually coated with a slipping layer to prevent the print head from sticking to the dye-donor element. Such a slipping layer would comprise either a solid or liquid lubricating material or mixtures thereof, with or without a polymeric binder or a surface-active agent. Preferred lubricating materials include oils or semicrystalline organic solids that melt below 100° C. such as poly(vinyl stearate), beeswax, microcrystalline wax, perfluorinated alkyl ester polyethers, polycaprolactone, silicone oils, polytetrafluoroethylene, carbowaxes, poly (ethylene glycols), or any of those materials disclosed in U.S. Pat. Nos. 4,717,711; 4,717,712; 4,737,485; and 4,738,950, and EP 285,425, page 3, lines 25–35. Suitable polymeric binders for the slipping layer include poly(vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40 weight %, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal or a poly(ethylene terephthalate). The support for the dye-receiving element may also be reflective such as baryta-coated paper, polyethylene-coated paper, an ivory paper, a condenser paper or a synthetic paper such as DuPont Tyvek®. Pigmented supports such as white polyester (transparent polyester with white pigment incorporated therein) may also be used. The dye-receiving element may also comprise a solid, injection-molded material such as a polycarbonate, if desired.

The dye image-receiving layer may comprise, for example, a polycarbonate, a polyurethane, a polyester, poly (vinyl chloride), poly(styrene-co-acrylonitrile), polycaprolactone, a poly(vinyl acetal) such as poly(vinyl alcohol-co-butyral), poly(vinyl alcohol-co-benzal), poly (vinyl alcohol-co-acetal) or copolymers or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the dye thereon as described above or may have alternating areas of other different dyes, such as sublimable cyan and/or magenta and/or yellow and/or black or other dyes. Such dyes are disclosed in U.S. Pat. Nos. 4,541,830; 4,541,830; 4,698,651; 4,695,287; 4,701,439; 4,757,046; 4,743,582; 4,769,360; and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, yellow and a dye as described above which is of magenta hue, and the above process steps are sequentially performed for each color to obtain a three-color dye transfer image. Of course, when the process is only performed for a single color, then a monochrome dye transfer image is obtained.

Thermal print heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLES

Example 1

Preparation of Cyan Dye-Donor Elements of the Invention

Cyan dye-donor elements were prepared by applying a corona discharge treatment to a 6$\mu$ poly(ethylene terephthalate) support and then coating with the following layers:

1) a subbing layer as specified in Table 3 (0.108 g/m$^2$ total dry weight) from water; and 2) a dye-layer containing a solid particle dispersion (avg. particle size approx. 0.2 $\mu$m) of Cyan Dye C-1 illustrated above (0.43 g/m$^2$) in a poly(vinyl pyrrolidone) (International Specialty Products) (0.05 g/m$^2$), and poly(styrene-co-butyl acrylate-co-hydroxyethyl methacrylate-co-2-sulfoethyl methacrylate sodium salt) 50/30/10/10 mol- % binder coated from water.

TABLE 3

| Dye-Donor Element | Glycidyl Polymer Laydown (g/m$^2$) | Additive Material Laydown (gm$^2$) | Weight Ratio |
|---|---|---|---|
| 1 | G-1 (0.108) | None | 100/0 |
| 2 | G-1 (0.105) | A-1 (0.002) | 98/2 |
| 3 | G-1 (0.100) | A-1 (0.007) | 93/7 |
| 4 | G-1 (0.097) | A-2 (0.011) | 90/10 |
| 5 | G-1 (0.097) | A-3 (0.011) | 90/10 |
| 6 | G-1 (0.022) | A-4 (0.086) | 20/80 |
| 7 | G-2 (0.108) | None | 100/0 |

TABLE 3-continued

| Dye-Donor Element | Glycidyl Polymer Laydown (g/m$^2$) | Additive Material Laydown (gm$^2$) | Weight Ratio |
|---|---|---|---|
| 8 | G-2 (0.105) | A-1 (0.002) | 98/2 |
| 9 | G-2 (0.097) | A-2 (0.011) | 90/10 |
| 10 | G-2 (0.097) | A-3 (0.011) | 90/10 |
| 11 | G-2 (0.022) | A-4 (0.086) | 20/80 |
| 12 | G-3 (0.108) | None | 100/0 |
| 13 | G-3 (0.107) | A-1 (0.001) | 99/1 |
| 14 | G-3 (0.097) | A-2 (0.011) | 90/10 |
| 15 | G-3 (0.097) | A-3 (0.011) | 90/10 |
| 16 | G-3 (0.022) | A-4 (0.086) | 20/80 |

On the backside of the dye-donor element were coated the layers:

1) a subbing layer of Tyzor TBT®, a titanium tetrabutoxide (DuPont Company) (0.13 g/m$^2$) coated from 15:85 wt- % 1-butanol and propyl acetate mixture; and
2) a slipping layer of poly(vinyl acetal) (Sekisui Kagaku KK) (0.38 g/m$^2$), a Candelilla wax dispersion (7 wt- % in methanol) (0.022 g/m$^2$), PS513, an amino-terminated polydimethylsiloxane (Huels) (0.011 g/m$^2$), and p-toluenesulfonic acid (0.0003 g/m$^2$) coated from a 98:2 wt- % 3-pentanone/distilled water mixture.

Control dye-donor elements were coated in the same manner as the invention elements above but using the following subbing materials:

TABLE 4

| Dye-Donor Element | Subbing Material Laydown (g/m$^2$) |
|---|---|
| C-1 | Poly(butyl methacrylate) (0.108) |
| C-2 | Poly(butyl acrylate-co-hydroxyethyl methacrylate-co-methyl 2-acrylamido-2-methoxyacetate) 50/25/25 wt-% (0.108) (U.S. Pat. 5,122,502) |
| C-3 | None |

Preparation of Dye=Receiving Element

The dye-receiving element was prepared by coating the following layers in order onto a microvoided polypropylene layer laminated to a per support as disclosed in U.S. Pat. No. 5,244,861 with a poly(vinyl alcohol)/poly(ethylene oxide) antistatic backing layer:

1) a subbing layer of Prosil 221® (an aminopropyltriethoxysilane, PCR, Inc.) (0.05 g/m$^2$) and Prosil 2210® (an amino-functional epoxysilane, PCR, Inc.) (0.05 g/m$^2$) coated from 3A alcohol;
2) a receiving layer of KL3-1013 (polyether-modified bisphenol A polycarbonate, Bayer AG) (1.78 g/m$^2$); Lexan 141® (bisphenol A polycarbonate, General Electric Co.) (1.45 g/m$^2$); diphenyl phthalate (0.32 g/m$^2$); and Fluorad FC-431® (a perfluoro-sulfonamido surfactant, 3M Corp.) (0.01 g/m$^2$); from methylene chloride solvent; and
3) an overcoat layer of a bisphenol A polycarbonate containing 49 mol- % diethylene glycol and 1 mol- % polydimethylsiloxane (0.22 g/m$^2$), DC-510® Silicone Fluid (Dow Corning) (0.008 g/m$^2$), and Fluorad FC-431® (0.016 g/m$^2$) coated from methylene chloride solvent.

Preparation of Thermal Dye Transfer Images

Eleven-step sensitometric thermal dye transfer images were prepared from the above dye-donor and dye-receiving elements. The dye side of the dye-donor element, approximately 10 cm×15 cm in area, was placed in contact with a receiving-layer side of a dye-receiving element of the same area. This assemblage was clamped to a stepper motor-driven, 60 mm diameter rubber roller. A thermal head (TDK model no. L-231, resolution of 5.4 dots/mm, thermostated at 25° C.) was pressed with a force of 24.4 Newton (2.5 kg) against the dye-donor element side of the assemblage, pushing it against the rubber roller.

Imaging electronics were activated causing the donor-receiver assemblage to be drawn through the print head/roller nip at 20.3 mm/sec. Coincidentally, the resistive elements in the print head were pulsed for 127.75 ms/pulse at 130.75 ms intervals during a 8.63 ms/dot printing cycle. A stepped image density was generated by incrementally increasing the number of pulses/dot from a minimum of 0 to a maximum of 64 pulses/dot. The voltage supplied to the head was approximately 12.5 volts resulting in an instantaneous peak power of 0.312 watts/dot and a maximum total energy of 2.55 mJ/dot.

The dye-donor element was separated from the dye-receiving element immediately upon exiting the printing nip. After one stepped density image was generated, the printing cycle was repeated with a new area of dye-donor onto the same area of dye-receiver. This was repeated until the receiver showed sticking to the dye-donor upon separation. The number of the first print which showed sticking was recorded as "prints to fail". A value of greater than 6 indicated that no sticking was observed and the test was discontinued. The following results were obtained:

TABLE 5

| Dye-Donor Element | Glycidyl Polymer | Additive Material | Wt Ratio | Dmax | Prints to Fail |
|---|---|---|---|---|---|
| 1 | G-1 | | 100/0 | 2.3 | 5 |
| 2 | G-1 | A-1 | 98/2 | 2.4 | 5 |
| 3 | G-1 | A-1 | 93/7 | 2.3 | 5 |
| 4 | G-1 | A-2 | 90/10 | 2.3 | 6 |
| 5 | G-1 | A-3 | 90/10 | 2.3 | 6 |
| 6 | G-1 | A-4 | 20/80 | 2.4 | >6 |
| 7 | G-2 | | | 2.2 | 6 |
| 8 | G-2 | A-1 | 98/2 | 2.3 | 6 |
| 9 | G-2 | A-2 | 90/10 | 2.3 | 6 |
| 10 | G-2 | A-3 | 90/10 | 2.3 | >6 |
| 11 | G-2 | A-4 | 20/80 | 2.5 | >6 |
| 12 | G-3 | | | 2.3 | 3 |
| 13 | G-3 | A-1 | 99/1 | 2.4 | 4 |
| 14 | G-3 | A-2 | 90/10 | 2.1 | 4 |
| 15 | G-3 | A-3 | 90/10 | 2.3 | 3 |
| 16 | G-3 | A-4 | 20/80 | 2.4 | >6 |
| C-1 | | | | 2.4 | 2 |
| C-2 | | | | 2.3 | 4 |
| C-3 | | | | 2.3 | 1 |

The above results show that without the subbing layer (C-3), there is significant delamination of the dye layer on the initial dye transfer. The addition of a non-crosslinked acrylic subbing layer (C-1) improves the adhesion of the dye layer to the support but delamination still occurs before the 3 prints necessary to achieve a full color image. The crosslinked subbing layer (C-2) described in U.S. Pat. No. 122,502 performs just adequately with this dye layer.

The incorporation of glycidyl groups into the subbing layer in accordance with the invention improves the "prints to fail" performance. At high levels of glycidyl groups (G-1 and G-2, 100 and 30 wt- % glycidyl monomer respectively), an effective crosslinked network can be set up with or without the addition of other materials to engage in the crosslinking. At low levels of glycidyl groups (G-3, 10 wt- % glycidyl monomer), better performance is observed in the presence of high levels of additive polymers.

Example 2

Preparation of Magenta Dye-Donor Elements of the Invention

Magenta dye-donor elements were prepared by applying a corona discharge treatment to a 6$\mu$ poly(ethylene terephthalate) support and then coating with the following layers:

1) a subbing layer as specified in Table 6 (0.054 g/m$^2$ total dry weight) from water; and
2) a dye layer containing the Magenta Dye M-4 illustrated above (0.151 g/m$^2$), a mixture of cellulose acetate propionate, CAP-482-.05 (0.048 g/m$^2$) and CAP-482-20 (0.113 g/m$^2$) (Eastman Chemical Company), poly (butyl methacrylate-co-Zonyl TM®) 75:25, where Zonyl TM® is a fluorinated acrylate monomer (DuPont Company) (0.032 g/m$^2$), Paraplex G25®, a polyester sebacate (C. P. Hall Company) (0.022 g/m$^2$), and the 2,4,6-trimethylanilide of phenylindan-diacid (0.011 g/m$^2$), coated from a toluene/methanol/cyclohexanone (70/25/5) mixture.

TABLE 6

| Dye-Donor Element | Glycidyl Polymer Laydown (g/m$^2$) | Additive Material Laydown (g/m$^2$) | Weight Ratio |
|---|---|---|---|
| 17 | G-2 (0.005) | A-4 (0.048) | 10/90 |
| 18 | G-2 (0.011) | A-4 (0.043) | 20/80 |
| 19 | G-2 (0.016) | A-4 (0.038) | 30/70 |
| 20 | G-2 (0.022) | A-4 (0.032) | 40/60 |
| 21 | G-2 (0.027) | A-4 (0.027) | 50/50 |
| 22 | G-2 (0.005) | A-5 (0.048) | 10/90 |
| 23 | G-2 (0.011) | A-5 (0.043) | 20/80 |
| 24 | G-2 (0.016) | A-5 (0.038) | 30/70 |
| 25 | G-2 (0.022) | A-5 (0.032) | 40/60 |
| 26 | G-3 (0.005) | A-4 (0.048) | 10/90 |
| 27 | G-3 (0.011) | A-4 (0.043) | 20/80 |
| 28 | G-3 (0.016) | A-4 (0.038) | 30/70 |
| 29 | G-3 (0.022) | A-4 (0.032) | 40/60 |
| 30 | G-3 (0.027) | A-4 (0.027) | 50/50 |
| 31 | G-3 (0.005) | A-5 (0.048) | 10/90 |
| 32 | G-3 (0.011) | A-5 (0.043) | 20/80 |
| 33 | G-3 (0.016) | A-5 (0.038) | 30/70 |
| 34 | G-3 (0.022) | A-5 (0.032) | 40/60 |
| 35 | G-3 (0.027) | A-5 (0.027) | 50/50 |
| 36 | G-3 (0.032) | A-5 (0.022) | 60/40 |
| 37 | G-3 (0.038) | A-5 (0.016) | 70/30 |
| 38 | G-2 | none | 100/0 |

The backside of the donor-element was coated as described in Example 1.

Control dye-donor elements were coated in the same manner as the invention elements above but using the following subbing materials:

TABLE 7

| Dye-Donor Element | Subbing Material Laydown (g/m$^2$) |
|---|---|
| C-4 | A-4 (0.054) |
| C-5 | A-5 (0.054) |
| C-6 | None |

Preparation of Dye-Receiving Element

The dye-receiving element was prepared as in Example 1 except that the receiving layer was the sulfonic acid form of AQ29D®, poly[isophthalic acid-co-5-sulfoisophthalic acid (90:10 molar ratio)-diethylene glycol] (100 molar ratio) (Eastman Chemical Company) (2.36 g/m$^2$), poly(butyl acrylate-co-allyl methacrylate) 98:2 wt core/poly(glycidyl methacrylate) 10 wt shell (2.31 g/m$^2$), Dowfax 2A1®, anionic surfactant (Dow Chemical Company) (0.047 g/m$^2$), Snowtex ST-O®, colloidal silica articles (Nissan Chemical Company) (1.076 g/m$^2$) coated from water. No overcoat layer was employed.

Preparation of Thermal Dye Transfer Images

Images were prepared from the dye-donor and dye-receiver elements in the manner described in Example 1, except using a 4.75 ms/dot printing cycle. The voltage supplied to the head was approximately 12 volts resulting in an instantaneous peak power of 0.287 watts/dot and a maximum total energy of 1.17 mJ/dot. The adhesion of the dye-layer to its support/subbing layer was evaluated as "prints to fail" as described in Example 1. The following results were obtained:

TABLE 8

| Dye-Donor Element | Glycidyl Polymer | Additive Material | Wt Ratio | Prints to Fail |
|---|---|---|---|---|
| 17 | G-2 | A-4 | 10/90 | >6 |
| 18 | G-2 | A-4 | 20/80 | >6 |
| 19 | G-2 | A-4 | 30/70 | >6 |
| 20 | G-2 | A-4 | 40/60 | >6 |
| 21 | G-2 | A-4 | 50/50 | >6 |
| 22 | G-2 | A-5 | 10/90 | 6 |
| 23 | G-2 | A-5 | 20/80 | >6 |
| 24 | G-2 | A-5 | 30/70 | >6 |
| 25 | G-2 | A-5 | 40/60 | >6 |
| 26 | G-3 | A-4 | 10/90 | >6 |
| 27 | G-3 | A-4 | 20/80 | >6 |
| 28 | G-3 | A-4 | 30/70 | >6 |
| 29 | G-3 | A-4 | 40/60 | >6 |
| 30 | G-3 | A-4 | 50/50 | >6 |
| 31 | G-3 | A-5 | 10/90 | 5 |
| 32 | G-3 | A-5 | 20/80 | >6 |
| 33 | G-3 | A-5 | 30/70 | 6 |
| 34 | G-3 | A-5 | 40/60 | >6 |
| 35 | G-3 | A-5 | 50/50 | >6 |
| 36 | G-3 | A-5 | 60/40 | >6 |
| 37 | G-3 | A-5 | 70/30 | 6 |
| 38 | G-2 | | 100/0 | >6 |
| C-4* | | A-4 | 0/100 | >6 |
| C-5 | | A-5 | 0/100 | 1 |
| C-6 | | none | | 1 |

*This material was tacky and difficult to work with in coated form.

The above results show that without a subbing layer (C-6) there is significant delamination of the dye layer on the initial dye transfer. The use of G-2 (polymer containing 30 wt- % glycidyl monomer) provides an effective subbing layer alone or in combination with amine-containing polymers over a wide range of compositions. The addition of G-3 (polymer containing 10 wt- % glycidyl monomer) improves the performance of the amine-containing polymers A-4 and A-5.

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having on one side thereof, in order, a subbing layer and a dye layer, and wherein said subbing layer comprises a glycidyl-containing polymer or copolymer having the following recurring monomer units:

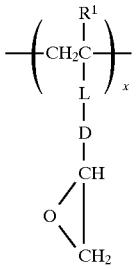

wherein:

$R^1$ is H or methyl;

L is a linking group;

D is an alkylene group of 1 to 6 carbon atoms; and x represents from about 10 to about 100 weight percent.

2. The element of claim 1 wherein $R^1$ is methyl, L is carboxyl, and D is methylene (—$CH_2$—).

3. The element of claim 1 wherein said subbing layer comprises a copolymer of at least about 10 weight percent of said glycidyl-containing monomer and another acrylate or vinyl monomer.

4. The element of claim 1 wherein said subbing layer comprises a mixture of a polymer containing at least about 10 weight percent of said glycidyl-containing monomer and the balance a polyfunctional amine, alcohol, or acid.

5. The element of claim 1 wherein the other side of said support has thereon a slipping layer.

6. The element of claim 1 wherein said support is poly (ethylene terephthalate).

7. A process of forming a dye transfer image comprising:

(a) imagewise-heating a dye-donor element comprising a support having on one side thereof, in order, a subbing layer and a dye layer, and (b) transferring a dye image to a dye-receiving element to form said dye transfer image, wherein said subbing layer comprises a glycidyl-containing polymer or copolymer having the following recurring monomer units:

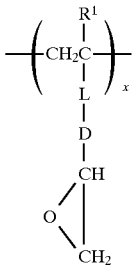

wherein:

$R^1$ is H or methyl;

L is a linking group;

D is an alkylene group of 1 to 6 carbon atoms; and x represents from about 10 to about 100 weight percent.

8. The process of claim 7 wherein $R^1$ is methyl, L is carboxyl, and D is methylene (—$CH_2$—).

9. The process of claim 7 wherein said subbing layer comprises a copolymer of at least about 10 weight percent of said glycidyl-containing monomer and another acrylate or vinyl monomer.

10. The process of claim 7 wherein said subbing layer comprises a mixture of a polymer containing at least about 10 weight percent of said glycidyl-containing monomer and the balance a polyfunctional amine, alcohol, or acid.

11. The process of claim 7 wherein the other side of said support has thereon a slipping layer.

12. The process of claim 7 wherein said support is poly(ethylene terephthalate).

13. A thermal dye transfer assemblage comprising (a) a dye-donor element comprising a support having on one side thereof, in order, a subbing layer and a dye layer, and (b) a dye-receiving element comprising a support having thereon a dye image-receiving layer, said dye-receiving element being in a superposed relationship with said dye-donor element so that said dye layer is in contact with said dye image-receiving layer, wherein said subbing layer comprises a glycidyl-containing polymer or copolymer having the following recurring monomer units:

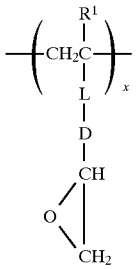

wherein:

$R^1$ is H or methyl;

L is a linking group;

D is an alkylene group of 1 to 6 carbon atoms; and x represents from about 10 to about 100 weight percent.

14. The assemblage of claim 13 wherein $R^1$ is methyl, L is carboxyl, and D is methylene (—$CH_2$—).

15. The assemblage of claim 13 wherein said subbing layer comprises a copolymer of at least about 10 weight percent of said glycidyl-containing monomer and another acrylate or vinyl monomer.

16. The assemblage of claim 13 wherein said subbing layer comprises a mixture of a polymer containing at least about 10 weight percent of said glycidyl-containing monomer and the balance a polyfunctional amine, alcohol, or acid.

17. The assemblage of claim 13 wherein the other side of said support has thereon a slipping layer.

18. The assemblage of claim 13 wherein said support is poly(ethylene terephthalate).

* * * * *